United States Patent [19]

Kemeny

[11] Patent Number: 4,577,545

[45] **Date of Patent: * Mar. 25, 1986**

[54] PARALLEL RAIL ELECTROMAGNETIC LAUNCHER WITH MULTIPLE CURRENT PATH ARMATURE

[75] Inventor: George A. Kemeny, Wilkins Township, Allegheny County, Pa.

[73] Assignee: Westinghouse Electric Corp., Pittsburgh, Pa.

[ * ] Notice: The portion of the term of this patent subsequent to Dec. 4, 2001 has been disclaimed.

[21] Appl. No.: 650,025

[22] Filed: Sep. 13, 1984

Related U.S. Application Data

[63] Continuation of Ser. No. 381,603, May 24, 1982, Pat. No. 4,485,720.

[51] Int. Cl.[4] ..... F41F 1/02

[52] U.S. Cl. ..... 89/8; 124/3; 310/13

[58] Field of Search ..... 89/8; 124/3; 310/10, 310/12, 13; 318/135; 307/64, 66

[56] References Cited

U.S. PATENT DOCUMENTS

| | | | |
|---|---|---|---|
| 1,370,200 | 3/1921 | Fauchon-Villeplee | 310/13 X |
| 1,422,427 | 7/1922 | Fauchon-Villeplee | 310/13 X |
| 4,319,168 | 3/1982 | Kemeny | 124/3 X |
| 4,343,223 | 8/1982 | Hawke et al. | 124/3 X |
| 4,347,463 | 8/1982 | Kemeny et al. | 310/13 X |
| 4,384,213 | 5/1983 | Bogel | 307/64 |
| 4,433,608 | 2/1984 | Deis et al. | 89/8 |
| 4,457,205 | 7/1984 | Ross | 89/8 |
| 4,467,696 | 8/1984 | McNab et al. | 89/8 |
| 4,480,523 | 11/1984 | Young et al. | 124/3 X |
| 4,485,720 | 12/1984 | Kemeny | 89/8 |

*Primary Examiner*—David H. Brown
*Assistant Examiner*—John E. Griffiths
*Attorney, Agent, or Firm*—R. P. Lenart

[57] ABSTRACT

Electromagnetic projectile launchers utilize multiple current path armatures in an internally series augmented conductor rail configuration or an internally augmented system connected to multiple power supplies. The current paths include plasmas, conductors or combinations of both. Plasma separation is maintained by trailing insulating plasma dividers extending toward the launcher breech from arc driving faces on a projectile sabot. Arc length and/or plasma volume is reduced by conductive assemblies adjacent to the arc driving faces.

4 Claims, 14 Drawing Figures

PARALLEL RAIL ELECTROMAGNETIC LAUNCHER WITH MULTIPLE CURRENT PATH ARMATURE

This is a continuation of application Ser. No. 381,603, filed May 24, 1982, U.S. Pat. No. 4,485,720 issued Dec. 4, 1984.

BACKGROUND OF THE INVENTION

This invention relates to electromagnetic projectile launchers and more particularly to such launchers having parallel projectile launching rails and using multiple plasma drives.

Parallel rail electromagnetic launchers which utilize a single pair of projectile rails require very high currents to achieve projectile velocities in excess of those obtained with conventional accelerating means such as explosives. In order to achieve a given accelerating force with a lower current, various augmentation schemes have been proposed. External augmentation is accomplished by placing additional conductors outside of the bore to increase bore flux and thereby increase the force exerted by a given current level in the armature or driving plasma. Only this type of augmented configuration has previously been considered suitable for arc or plasma drive because there is only a single arc driving the projectile or sabot and hence no possibility of parallel arcs at different potentials unfavorably fusing into a single arc.

Internally augmented launchers have additional conductors disposed along the interior of the bore. These launchers have previously only been considered viable with conducting armatures because internal series augmentation requires more than one conducting path or loop through the armature assembly. In addition, each of these multiplicity of paths in the prior art is at a different potential from the adjacent one and must be insulated from it. Since conducting armatures have only been demonstrated for velocities below about 1000 meters per second, internal series augmentation launchers have been relegated to larger bore artillery, torpedoes, missile launching, etc., all relatively low velocity systems.

For a given number of conductor pairs, internal series augmentation results in the highest force increase at a given current and yields the greatest current reduction compared to a simple parallel rail launcher operated at the same propelling force. Thus internal series augmentation is highly desirable from high propelling force and current reduction considerations, but the deemed impossibility of insulatably operating parallel arcs at different potentials against the rear face of a driving sabot has inhibited consideration of internally series augmented launchers using plasma drive.

Electromagnetic projectile launchers constructed in accordance with this invention include multiple parallel conductor pairs disposed along the perimeter of the launcher bore. Multiple plasmas which serve as conduction paths between these conductors provide means for propelling a projectile along the conductors. Means for preventing the merger of the multiple plasmas include insulating plasma dividers extending from an insulating sabot. In an internally series augmented conductor configuration, a source of high current supplies current to a conductor system connected such that current in adjacent conductors flows in the same direction. Alternatively, the conductors can be connected such that current in adjacent conductors flows in the opposite direction.

The potential different between adjacent conductors is minimized in an alternative embodiment through the use of multiple sources of high current wherein each pair of conductors and the associated plasma are supplied by an independent current source. Conducting elements which extend between the conductor pairs but have ends which are spaced a preselected distance from the conductors are attached to the driving sabot to reduce the total plasma length and volume between the conductors. U.S. Pat. No. 4,467,696, issued Aug. 28, 1984 and entitled "Electromagnetic Launcher With Combination Plasma/Conductor Armature", discloses a single current path armature launcher and is hereby incorporated by reference.

DESCRIPTION OF THE PREFERRED EMBODIMENT

Figure 1:
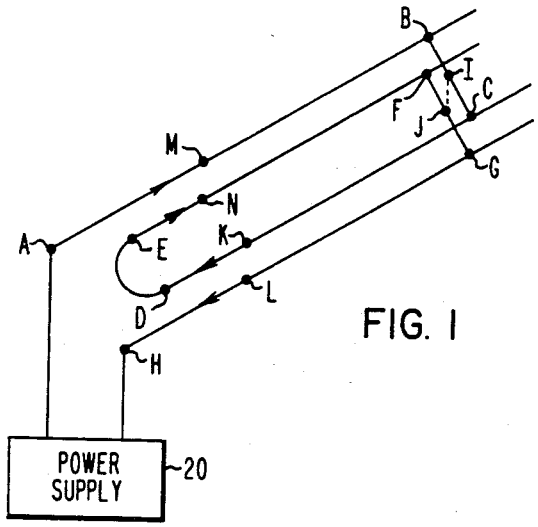
FIG. 1 is a schematic diagram of an internally series augmented electromagnetic launcher in accordance with one embodiment of the present invention.

Referring to the drawings, FIG. 1 is a schematic diagram of an internally series augmented electromagnetic launcher employing two pairs of projectile accelerating conductors, sometimes referred to as rails. Power supply 20 is a source of high current such as a homopolar generator-inductor pulse power supply, a capacitor bank or a rotating pulse generating machine, connected to the breech of the launcher rails at points A and H. If the projectile package has been flawlessly accelerated, current will flow in the path ABCDEFGH as illustrated by the arrows in FIG. 1. In this launcher, there are two current paths BC and FG across an armature slidably disposed between the projectile accelerating conductors. The potential difference between these two parallel paths will be a few tens of volts for low currents and at low projectile velocities to kilovolts at high currents and high velocities. In the present invention, an arc or plasma is used to conduct current across paths BC and FG.

If a fault condition occurs such that a short develops between points I and J in FIG. 1, the pulse current path of lowest impedance becomes ABIJGH. After transient conditions resulting from the short have decayed, the projectile propelling force will be reduced to an estimated one fourth of the pre-fault force because the two rail pair internally series augmented configuration has been reduced to a simple single rail pair launcher.

During the complex transient conditions following initiation of the I to J shorting, inductive energy stored in the now shorted loop ICDEFJI will, at least initially, cause current flow in the desired direction across the armature. Therefore some of the inductive energy stored in this loop will be usefully dissipated. However, any change in propelling current supplied to points A and H will now cause energy wasting current flow in this same loop. In essence, the now parasitic loop ICDEFJI is a shorted loop which opposes current change in the driving loop ABIJGH and thus the parasitic loop may finally even result in reverse current flow across the armature thereby further reducing the propelling force.

It should thus be apparent that shorting between armature conducting paths must be avoided as it will, at a minimum, cause a serious loss in driving force. A short across the driving rails, for example from K to L, would have approximately the same effect as an armature short. If two concurrent shorts occur, for example KL and MN, then all driving force can be lost. Any such shorting can be expected to also cause extensive conductor surface damage.

Figure 2A:
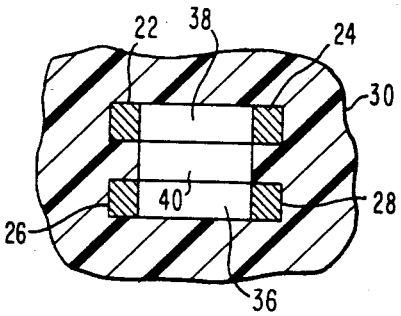
FIG. 2A is an end view of the bore of a launcher in accordance with an embodiment of this invention.

Launchers constructed in accordance with the present invention utilize plasma drive and are provided with means for preventing shorting and/or means which allow shorting but do not result in a reduction of driving force. FIG. 2A shows an end view of the breech of a two rail pair internally augmented launcher bore, housing a projectile package. Conductors 22, 24, 26 and 28 serve as projectile launching rails and are rigidly held in place in insulator 30. During a launch, plasmas are formed between conductors 22 and 24 and between conductors 26 and 28.

Figure 2B:
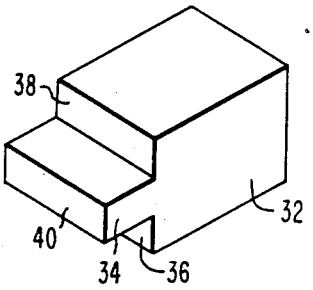
FIG. 2B is a perspective view of the insulating sabot shown in FIG. 2A.

FIG. 2B shows a perspective view of the projectile or sabot 32 of FIG. 2A which has been furnished with a trailing, insulating and ablative plasma divider 34 extending from plasma driving faces 36 and 38 on the rear of projectile or sabot 32. For this simple configuration, the two parallel plasmas are inhibited from shorting at the rear of the sabot by the intervening insulating plasma divider 34. The length of the divider 34 is sufficient so that at the divider face 40, enough cooling of the plasma has occurred to inhibit either an I to J type of short between driving arcs or a K to L type of short between conductor rails at the rear of the projectile. By making divider 34 out of material such as, for example, Teflon, ablation will not only help to rapidly cool the plasmas but additionally, the gas generated by ablation will increase withstand voltage in the wake of the projectile. It should be observed that the two parallel plasmas conduct current in the same direction and thus, were it not for the divider, almost instantaneous fusing of the plasmas would occur not only becuase of their electric potentials, but also because of the electromagnetic collapsing force between parallel conductors carrying current in the same direction.

Figure 3:
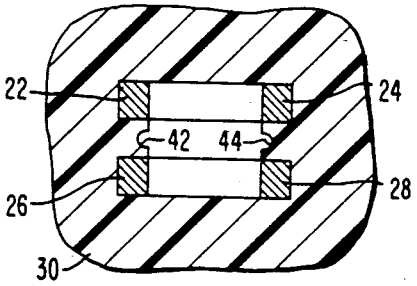
FIG. 3 is a partial end view of a launcher having a notched insulator in accordance with an embodiment of this invention.
Figure 4:
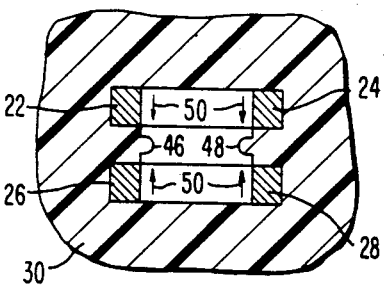
FIG. 4 is an end view of an alternate embodiment of the launcher of FIG. 2A.

Breakdown across the sides of the divider or in the wake of the sabot may be further inhibited by using a non-planar construction of the divider sides as shown in FIG. 3. In this embodiment, insulator 30 is provided with longitudinal grooves 42 and 44 in the perimeter of the bore partially formed by conductors 22, 24, 26 and 28. FIG. 4 shows a similar construction where protrusions 46 and 48 appear on insulator 30 in the perimeter of the bore formed by conductors 22, 24, 26 and 28. Arrows 50 illustrate the direction of plasma pressures which help to seal rail insulation sliding contact areas. In FIGS. 3 and 4, the plasma divider and if desired, the whole sabot is shaped to slidably fit within notches 43 and 44 and around protrusions 46 and 48, respectively.

Figure 5:
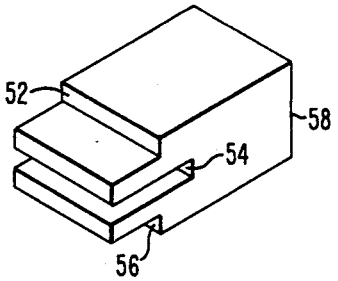
FIG. 5 is a perspective view of an insulating sabot for use with a launcher having three pairs of projectile propelling conductors.

FIG. 5 shows a more complicated divider configuration for a three parallel plasma arc drive system. Plasma drive faces 52, 54 and 56 on sabot 58 are separated longitudinally in the bore axis so as to not only reduce the attraction between the plasmas but also, by longer distances, limit the likelihood of breakdown at the sliding faces existing between the inter-rail insulation and the adjacent sabot and trailing divider insulating faces.

Figure 6:
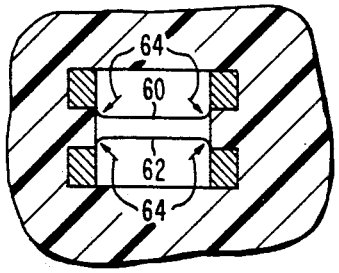
FIG. 6 is an end view of a launcher with an alternate embodiment of the sabot of FIG. 2B.

Deleterious leakage of hot plasma which may initiate a voltage breakdown followed by massive, destructive and propelling force reducing arcing between adjacent plasmas or conductors may be further hindered by shaping the intervening insulating structures so that plasma pressure helps to prevent plasma leakage. FIG. 6 shows a breech end view of a launcher containing a sabot with a divider having concave surfaces 60 and 62 resulting in feathered edges to improve sealing. Plasma pressure represented by arrows 64, acts to seal the sliding surfaces of the divider to the inter-rail insulator surfaces.

Figure 7:
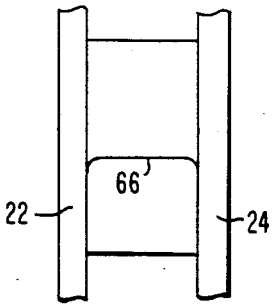
FIG. 7 is a top view of the sabot of FIG. 6.

FIG. 7 is a top view of the sabot of FIG. 6 showing how a concave sabot driving face 66 results in feathering which reduces the likelihood of plasma leakage into the sabot to conducting rail contact area. Although the feathered edges will rapidly wear away, so will the driving face and thus the structure is likely to survive for a few milliseconds of acceleration in about the shape indicated.

Figure 8:
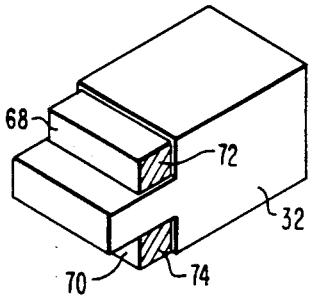
FIG. 8 is a perspective view of an alternate sabot having conductive elements.

FIG. 8 shows a combination plasma and conduction drive system wherein the sabot 32 is furnished with solid, laminated or transposed conductor elements 68 and 70 at its driving faces. Current continuity to the rails in each current path is maintained by two short series arcs or plasmas in each of the two gaps between the individual conductor assembly end and the adjacent conducting rail. Arc resistant materials may be used at arcing faces 72 and 74 and at corresponding arcing faces, not shown, on the opposite ends of conductor assemblies 68 and 70. Alternatively, the entire conductor assemblies 68 and 70 may be made of arc resistant materials such as copper-tungsten or graphite. In order to reduce electrical skin effect when high currents flow through conductor elements 68, a plurality of transposed conducting members can be used to construct conductor elements 68.

The FIG. 8 configuration has two arcs per armature current path and therefore twice as many arc contact drops per path as in a launcher employing arc drive without conductive assemblies. Because of excessive heat generation, this may be less desirable than a single arc per path for bores of a few centimeters. However for large bores and high velocities, the FIG. 8 two series arcs per path drive system is highly desirable and may be the only feasible configuration.

Figure 12:
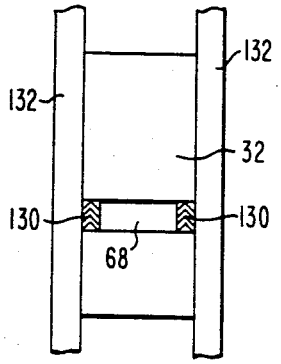
FIG. 12 is a top view of an alternate embodiment of the sabot of FIG. 8 showing the addition of chevron contact elements.

FIG. 12 illustrates the addition of contact elements 130 to the ends of conductor element 68 of FIG. 8. Although chevron shaped contact elements are shown, a variety of shapes may be used. The contact elements may serve as shooting wires to initiate an arc or plasma or they may be massive to serve as conducting members, maintaining contact with the launcher rails 132 and conductive element 68 throughout the launch.

Although FIG. 8 illustrates a sabot structure with two conducting elements 68 and 70 attached to the sabot driving faces which are coplanar, it should be understood that in the manner of FIG. 5, the conducting elements may be longitudinally spaced apart. These elements may also be located in suitable bores passing transversely through the sabot between rail pairs.

Sabot structures suitable for arc or plasma driving have been illustrated, for example as shown in FIG. 2B, and other sabot structures have been illustrated utilizing conductive elements as shown in FIG. 8. However, it should be understood that a single sabot structure may include one or more driving faces for plasmas or arcs in combination with one or more conductive elements.

In some launcher applications, plasma dividers may not adequately or consistently eliminate shorting induced by the plasma voltage difference or electromagnetic attractive forces. For these cases, multiple plasma drive launchers which reduce or eliminate these effects can be used. If massive currents cause the attractive forces between adjacent plasmas to become so high that the aforementioned plasma dividing or separating means prove insufficiently reliable, arc drive plasmas with opposite current flow directions can be used.

Figure 9A:
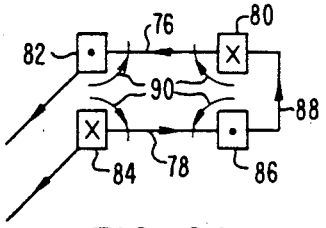
FIG. 9A is a breech end view of a launcher having opposite current flow in adjacent conductors in accordance with an embodiment of this invention.

FIG. 9A shows a breech end view of the bore of a launcher with opposite current flow in plasma paths 76 and 78 extending between conductors 80 and 82 and conductors 84 and 86 respectively. Circuit path 88 represents a shunt near the breech end of the launcher. Flux directions are indicated by arrows 90. Because of this current flow direction arrangement, plasmas 76 and 78 will tend to spread apart.

Figure 9B:
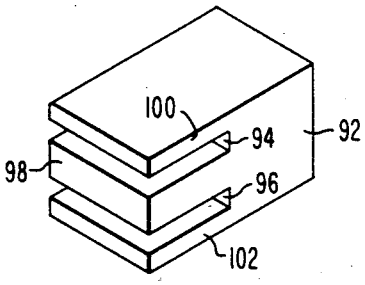
FIG. 9B is a perspective view of an insulating sabot for use with the launcher of FIG. 9A.

FIG. 9B shows a sabot 92 for use with the launcher of FIG. 9A. Plasma driving faces 94 and 96 are separated by plasma divider 98. Tabs 100 and 102 are added to protect the upper and lower insulated bore surfaces from damage caused by the spreading plasmas. By making tabs 100 and 102 somewhat flexible, which is actually quite unavoidable, they will also help to seal the bore. Such bore sealing tabs may also be added to the sabots of FIGS. 2B, 5 and 8.

The launcher of FIG. 9A can be expected to develop a force roughly about 2.4 times as great as a simple parallel rail launcher of the same bore size and at the same current. This is not as effective as the launcher of FIG. 2 with plasma currents flowing in the same direction, but is still a substantial improvement over a simple parallel rail launcher.

Figure 10:
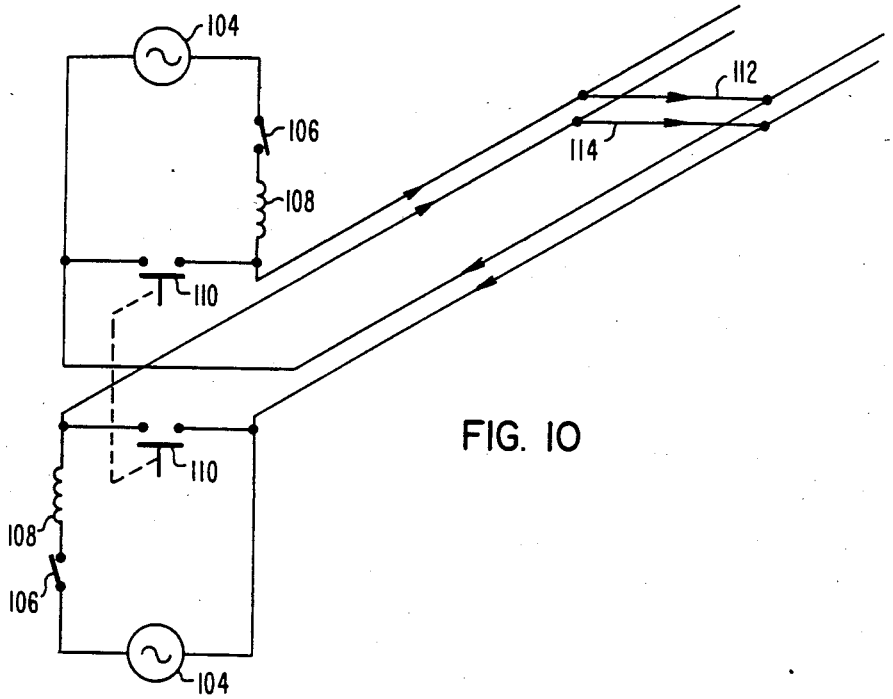
FIG. 10 is a schematic diagram of a multiple power supply launcher in accordance with this invention.

FIG. 10 is a schematic diagram of a two rail pair internally augmented launcher configuration wherein each rail pair if pulsed by a separate high current power supply. In the example shown, each power supply comprises the series connection of a homopolar generator 104, switch 106, inductor 108 and circuit breaker or firing switch means 110. It should be apparent that other high current power supplies such as capacitor-inductor systems and rotating pulse generators can also be used in such an essentially parallel arrangement.

It should be observed that in a high current launcher as shown in FIG. 10, the individual currents are first built up to the launch level in closed charging loops with breaker or switch means 110 shorted. Firing is then initiated by synchronously opening the breakers 110 thereby commutating the currents into the launching rail pairs. The driving plasmas or arcs are generally initiated by exploding fuse wires which bridge between conductor pairs and which are located at the sabot plasma driving faces.

If identical power supplies are used, the potential difference between plasmas 112 and 114 will be substantially eliminated. There will still be an electromagnetic attractive force between the two plasmas. However, if they do short, no reduction in driving force should result. The FIG. 10 type of launcher will require about the same firing energy as the launcher of FIG. 1 for the same firing scenario. Therefore there appears to be no penalty in efficiency through the use of multiple pulse systems and voltage differences in the bore perimeter will be far lower, which is beneficial.

Because the FIG. 10 multiple parallel power supply system allows shorting of plasmas without accelerating force deterioration, the sabot for such a system does not require plasma dividers such as 34 in FIG. 2B or 98 in FIG. 9B. Furthermore, if a sabot with conductive elements is utilized as illustrated in FIG. 8, a single conductive element alone can provide the current path between multiple rail pairs.

If a projectile must be accelerated to a high muzzle kinetic energy level, and especially if the system must be mobile or airborne, then the size, volume and weight of one or more capacitive power supplies is likely to be prohibitive and the utilization of kinetic energy storage systems such as the homopolar generator-inductor combination of FIG. 10 may be dictated by size and weight considerations. Homopolar-inductor systems are best suited for single stage launchers because of switching limitations. FIG. 10 shows a configuration in which circuit breakers or firing switch means 110 are ganged or interconnected to operate at approximately the same time. Since the projectile is just beginning to be accelerated when these circuit breakers operate, precise switching coordination is not as critical as in a multiple successive stage launcher.

Though the justification for parallel rail launchers with multiple plasma drive has been primarily to obtain high forces at far reduced current levels and thus shorter acceleration distances or barrels for attainment of high velocities, there exists another vital justification for the development of multiple armature path systems. In a high velocity simple parallel rail launcher with a conducting armature, skin effects, especially at high velocities, are expected to give very nonuniform current densities in the armature and rails and therefore a far from uniform propelling force distribution over the bore area. With arc drive using a single plasma in a simple parallel rail launcher, the current density and force distribution will be more uniform but for large bore sizes this will still be insufficient. A multiple path system such as in FIGS. 1, 9A and 10, particularly with many parallel paths, can give a far more consistent force distribution even over very large bore areas, using conductive armatures, or armatures of the type shown in FIG. 8 which include conductors or plasma drive systems.

A further advantage of a multiple armature path drive system is that a far more uniform current distribution occurs in the rails. Assume, for example, a bore 25 cm×25 cm and a massive acceleration scenario which would require a 7.5 million ampere current to obtain the required acceleration force in a simple parallel rail launcher. It can be expected that the 7.5 MA current will result in a disastrously non-uniform rail and armature current density distribution along the 25 cm rail height, with almost certain local rail and armature or rail arc spot melting due to excessive local current densities. If this same acceleration were accomplished with five parallel power supplies, in the manner of FIG. 10 with each delivering 1.5 MA, then each individual rail, which could now be about 4 cm high, would conduct 1.5 MA. This would force the current into a far more uniform current distribution and reduce or eliminate the likelihood of damage due to excessive local current densities, and would, as explained in the previous paragraph, give a far more uniform force distribution on the sabot driving face area.

Even in a single plasma drive system as in a simple parallel rail launcher, leakage of hot gases past the projectile package has to be restrained so as to prevent arc breakdown ahead of the projectile, followed by a possible loss of all driving current. However it has been found that due to the large acceleration forces, even quite rigid insulators will plastically deform and fill the bore at least in their rearward portion close to the driving face. For this reason, meeting the more stringent sealing requirements assocated with multiple and distinct plasmas in a single bore will also be aided by the plastic and bore sealing deformation which will occur at and toward the sabot driving force area.

Figure 11:
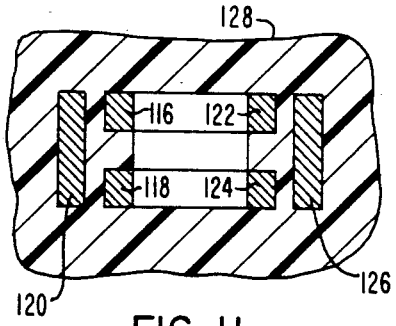
FIG. 11 is an end view of a launcher employing internal and external augmentation in accordance with one embodiment of this invention.

Though FIGS. 1, 9A and 10 only illustrate internal augmentation, each of these configurations may additionally use external parallel conductor pairs to beneficially both augment the bore flux and store inductive energy. FIG. 11 shows a breech end view of a launcher employing both internal and external augmentation.

In this launcher, conductors 116, 118 and 120 are connected such that during a launch, current flows in the same direction in each. This is also the case for conductors 122, 124, and 126. All of the conductors are held in place by rigid insulation 128. It should be apparent that other external augmentation schemes are possible within the scope of this invention. In launchers represented by FIGS. 2A, 3, 4, 6 and 11, the rigid insulation shown is not expected to be sufficient to restrain the large rail separating forces which are produced when currents flow in the individual conductor pairs. These forces can be restrained by additional strong, structural and stress bearing members which are not illustrated.

I claim:

1. An electromagnetic projectile launcher comprising:

four generally parallel conductors lining a bore;

a source of high current;

means for switching current from said high current source to said conductors;

means for conducting current between a first pair of said conductors and for propelling a projectile along said first pair of said conductors;

means for conducting current between a second pair of said conductors and for propelling said projectile along said second pair of said conductors;

said conductors extending along the entire acceleration distance of said projectile such that said means for conducting current between said first pair of conductors and said means for conducting current between said second pair of conductors each conduct current and propel said projectile over the entire projectile acceleration distance;

said means for conducting current between said first pair of said conductors including a first arc extending between said first pair of conductors;

said means for conducting current between said second pair of said conductors including a second arc extending between said second pair of conductors and being substantially parallel to said first arc; and a gap between said first and second arcs wherein said first and second arcs are allowed to short as said projectile is propelled along said conductors.

2. An electromagnetic projectile launcher comprising:

a first conductor;

a second conductor disposed generally parallel to said first conductor;

a first means for propelling a projectile from a first end of said first and second conductors to a second end thereof and for conducting current therebetween, said first means including a first plasma;

a first source of high current;

a third conductor disposed generally parallel to and adjacent said first conductor;

a fourth conductor disposed generally parallel to and adjacent said second conductor;

a second means for propelling said projectile from a first end of said third and fourth conductors to a second end thereof and for conducting current therebetween and substantially parallel to current in said first plasma, said second means including a second plasma;

a gap between said first and second plasmas wherein said first and second plasmas are allowed to short as said projectile is propelled along said conductors;

a second source of high current;

means for substantially simultaneously connecting said first source of high current to said first end of said first and second conductors and connecting said second source of high current to said first end of said third and fourth conductors; and said first, second, third and fourth conductors extending along the entire acceleration distance of said projectile, such that said first and second means for propelling each conduct current and propel said projectile over the entire acceleration distance.

3. An electromagnetic projectile launcher as recited in claim 2, further comprising:

an insulating sabot slidably and sealably disposed between said first and second conductors and between said third and fourth conductors.

4. An electromagnetic projectile launcher as recited in claim 2, wherein said means for substantially simultaneously connecting said first source of high current to said first end of said first and second rails and connecting said second source of high current to said first end of said third and fourth conductors, comprises:

a pair of substantially simultaneously actuated switches.

* * * * *